US005690804A

United States Patent [19]

Kuhlmann et al.

[11] Patent Number: 5,690,804

[45] Date of Patent: Nov. 25, 1997

[54] METHOD AND PLANT FOR REGENERATING SULFATE ELECTROLYTE IN STEEL STRIP GALVANIZING PROCESSES

[75] Inventors: Joachim Kuhlmann, Kreuztal; Ulrich Gläsker, Hilchenbach, both of Germany

[73] Assignee: SMS Schloemann-Siemag Aktiengesellschaft, Dusseldorf, Germany

[21] Appl. No.: 600,009

[22] Filed: Feb. 14, 1996

[30] Foreign Application Priority Data

Feb. 23, 1995 [DE] Germany ..... 195 06 297.3

[51] Int. Cl.[6] ..... C25D 21/18

[52] U.S. Cl. ..... 205/99; 204/206; 204/238; 204/DIG. 13; 205/101; 210/712; 210/722; 210/724

[58] Field of Search ..... 205/99, 101; 204/206–211, 204/237, 238, DIG. 13; 210/712, 722, 724, 726, 739, 743

[56] References Cited

U.S. PATENT DOCUMENTS

| | | | |
|---|---|---|---|
| 2,080,506 | 4/1937 | Rinck et al. | 205/99 |
| 2,200,987 | 5/1940 | Hubbell | 205/99 |
| 3,857,765 | 12/1974 | Merker et al. | 205/99 |
| 4,416,737 | 11/1983 | Austin et al. | 205/99 |
| 5,192,418 | 3/1993 | Hughes et al. | 205/100 |

FOREIGN PATENT DOCUMENTS

| | | | |
|---|---|---|---|
| 1-181000 | 7/1989 | Japan | C25D 21/16 |

OTHER PUBLICATIONS

Patent Abstracts Of Japan, vol. 13, No. 466 (C–646), 20. Oct. 1989 & JP–A–01 181000 (Kawasaki Steel Corporation), 18. Jul. 1989.

*Primary Examiner*—Bruce F. Bell
*Assistant Examiner*—William T. Leader
*Attorney, Agent, or Firm*—Friedrich Kueffner

[57] ABSTRACT

A method and a plant for regenerating zinc sulfate electrolyte in steel strip electrogalvanizing processes by precipitating dissolved iron from electrolyte circulating through a coating cell. A partial quantity of the circulating electrolyte to be regenerated is removed from the coating cell and the dissolved iron is oxidized to $Fe^{3+}$ by a redox-controlled addition of oxidizing agents. Subsequently, by raising the pH value to the precipitation limit of $Fe^{3+}$ by a controlled addition of a ZnO/water suspension or a $ZnCO_3$/water suspension, the dissolved iron is precipitated as sludge. Any excess ZnO or $ZnCO_3$ is then dissolved by adding fresh electrolyte. The precipitated iron sludge is conducted through a suitable filter such as a filter press, a filter belt, a decanter, etc., and the precipitated iron is filtered out in this manner. Subsequently, the purified partial quantity of the electrolyte is returned to the coating cell.

10 Claims, 1 Drawing Sheet

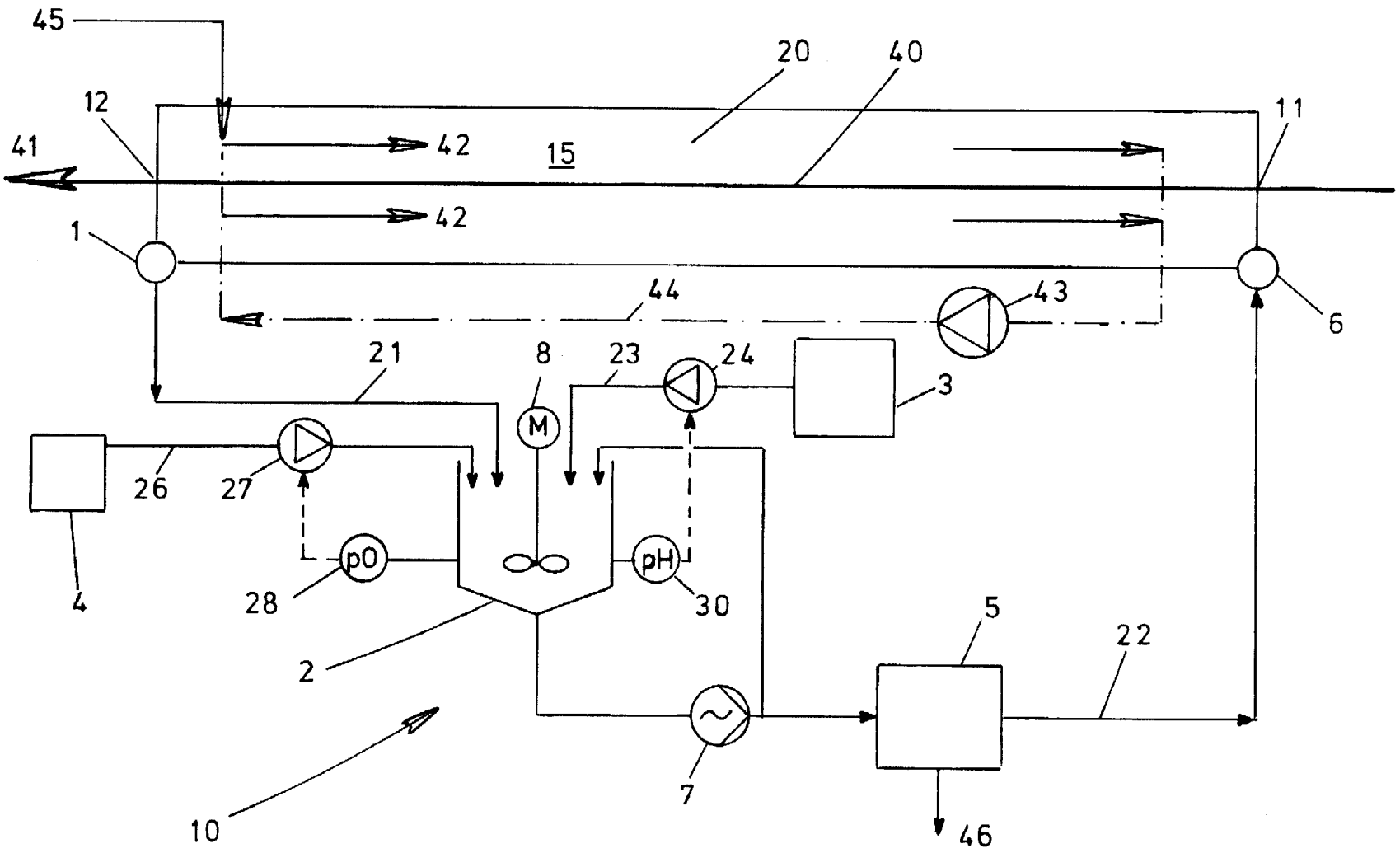
6
11
22
43
5
46
3
40
20
24
30
pH
7
44
23
15
8
M
42
42
21
pO
2
28
27
10
26
12
1
4
45
41

METHOD AND PLANT FOR REGENERATING SULFATE ELECTROLYTE IN STEEL STRIP GALVANIZING PROCESSES

BACKGROUND OF THE INVENTION

1. Field of the Invention

The present invention relates to a method and a plant for regenerating sulfate electrolyte in steel strip galvanizing processes by precipitating dissolved iron from the iron cycle.

2. Description of the Related Art

In galvanizing processes, a steel strip to be coated with zinc travels usually in continuous plants, after prior treatments in cleaning plants, degreasing plants and pickling plants, through one or more coating cells of acid-resistant material. In these cells, preferably insoluble anodes are used in an acid sulfate bath for the electrolytic zinc separation. By producing a favorable flow distribution of the electrolyte, special flow bodies and nozzle arrangements in the interior of the cell optimize the uniform separation of zinc or zinc/nickel on the strip surface.

During operation, contaminations with unwanted metals, such as, Fe, As, Cu, Cd, Sb and Pb occur in the galvanizing bath. These impurities would lead to impure coatings and, thus, to waste products. In order to prevent this, the zinc electrolytes or zinc/nickel electrolytes produced and processed in a separate plant part are monitored by extensive measuring and analyzing systems and the quality thereof is kept constant by mechanically and chemically separating the impurities. The electrolyte works in a circulation process, wherein fresh electrolyte enters at the strip exit of the cell, the electrolyte flows in a controlled flow to the strip entry and the electrolyte is returned in a controlled cycle by pumping, the electrolyte is filtered and the predetermined concentration of the electrolyte is adjusted and the electrolyte is purified from foreign metals, and the electrolyte is again pumped back to the strip exit of the cell.

In the prior art, it is known to remove dissolved iron produced during the process in the sulfate electrolyte in a cation exchanger. This has the disadvantage that large quantities of acid waste water are produced, which leads to operation problems and high costs of the removal.

From waste water technology it is known that dissolved metals are precipitated by raising the pH value and subsequently concentrating the metals. In plants of this type, dissolved salts used as neutralizing agents can be used without problems without impairing the process of waste water purification.

However, in contrast, the neutralizing agents used in waste water technology are not suitable for use in galvanizing processes which operate with zinc sulfate electrolytes; this is because the neutralizing agents enrich the electrolyte with salts, so that the galvanizing process is significantly impaired.

SUMMARY OF THE INVENTION

Therefore, it is the primary object of the present invention to provide a method and a plant of the above-described type for regenerating sulfate electrolyte in steel strip galvanizing processes by precipitating dissolved iron from the iron cycle, in which the above-described disadvantages and difficulties are avoided by using neutralizing agents which do not negatively influence the galvanizing process and which can be used with particularly economical means.

In accordance with the present invention, in a method of the above-described type, (a) a partial quantity to be regenerated is removed from the cycle of the electrolyte and (b) the iron dissolved in the partial quantity is oxidized to $Fe^{3+}$ by a redox-controlled addition of oxidizing agents. Subsequently, by raising the pH value to the precipitation limit by a controlled addition of a ZnO/water suspension or a $ZnCO_3$/water suspension, (c) the dissolved iron is precipitated as sludge. Any excess ZnO or $ZnCO_3$ is then dissolved by adding fresh electrolyte (d).

The method according to the present invention provides the advantage that the partial quantity of the electrolyte to be regenerated is completely purified of harmful impurities and particularly from dissolved iron. The precipitated iron sludge is conducted through a suitable filter, such as, a filter press, a filter belt, a decanter, etc., and the precipitated iron is filtered out in this manner. Subsequently, the purified partial quantity of the electrolyte is returned into the cycle (e).

The dissolved zinc is present in the electrolyte as $ZnSO_4$ and, thus, participates again without losses in the galvanizing process. The zinc dissolving station present in an automatic galvanizing plant is reduced in its output by that dissolution rate which corresponds to the quantity of zinc which has been precipitated. Consequently, the acid/metal equilibrium is not influenced.

In accordance with a further development of the method of the invention, $H_2O_2$ and/or air are used as oxidizing agents. In both cases, no harmful salts are introduced into the electrolyte.

In accordance with a preferred feature, the partial quantity to be regenerated can be removed from the galvanizing bath in the area of the strip exit and the regenerated partial quantity is then returned into the galvanizing bath in the area of the strip entry. However, the partial quantity can also be removed directly from the circulation system.

A further development of the present invention provides that the electrolyte is continuously stirred during the method steps (b) to (e).

In addition, another feature provides that the oxygen content in the electrolyte is measured during the method step (b) and the addition of oxidizing agent is metered in accordance with the measurement result.

Finally, another feature of the present invention provides that the pH value in the electrolyte is measured during the method step (c) and the addition of ZnO and/or $ZnCO_3$ is metered depending on the measurement result.

The plant for carrying out the method according to the present invention includes a reaction vessel with a stirring apparatus which is connected to a coating cell of the galvanizing bath through a discharge line and a return line. Connected to the reaction vessel are a supplementary vessel for oxidizing agent through a connecting line and a metering pump as well as an additional supplementary vessel through another connecting line and a metering pump. One of the metering pumps is in communication with a pH value sensor and the other metering pump is in communication with a measuring unit for determining the oxygen content in the electrolyte. A filter for filtering solids is arranged in the return line.

A further development of the plant according to the present invention provides that the discharge line is connected to a discharge location of the coating cell in the area of the strip exit and the return line is connected to an adding point of the coating cell in the area of the strip entry.

In accordance with another feature, the coating cell includes a cycle of the electrolyte in which the electrolyte flows in a direction opposite the strip travel direction and a circulation line with a circulation pump.

BRIEF DESCRIPTION OF THE DRAWING

In the drawing:

The single figure of the drawing is a schematic diagram showing a preferred embodiment of the plant according to the present invention.

DESCRIPTION OF THE PREFERRED EMBODIMENTS

The drawing shows a processing station 10 for regenerating sulfate electrolyte in the galvanizing bath 15 of a galvanizing plant for steel strip. Of the galvanizing plant, only a coating cell 20 is shown. The strip 40 to be galvanized is guided through the coating cell 20 by means of guide elements, not shown, and travels through the coating cell 20 from the strip entry or inlet 11 to the strip exit 12 in the strip travel direction 41. In the opposite direction, the electrolyte is conducted in the galvanizing bath 15 in a flow direction 42 through the coating cell 20 and, as schematically indicated, the electrolyte is circulated in a strong flow by means of a circulation line 44 and a circulation pump 43 arranged in the circulation line 44. Fresh electrolyte is added as required through the input line 45 of the coating cell 20.

The processing station 10 includes a reaction vessel 2 which is connected to the coating cell 20 of the galvanizing bath 15 through a discharge line 21 and a return line 22. The reaction vessel 2 includes a stirring apparatus 8. In addition, the reaction vessel 2 is in communication with a supplementary vessel 4 for oxidizing agent through a connecting line 26 and a metering pump 27 and with an additional supplementary vessel 3 for a ZnO/water suspension and/or a $ZnCO_3$/water suspension through a connecting line 23 and a metering pump 24. The metering pump 24 is connected to pH value sensor 30 and the metering pump 27 is connected to a measuring unit 28 for determining the oxygen content in the electrolyte. A filter 5 for filtering solids and means 46 for removing precipitated iron sludge are arranged in the return line 22. Purified electrolyte is returned into the coating cell 20 through the return line 22 at the input point 6 in the area of the strip inlet 11.

As shown in the drawing, the discharge line 21 is connected to a discharge point 1 of the coating cell 20 in the area of the strip exit 12 and the return line 22 is connected to an input point 6 of the coating cell 20 in the area of the strip entry 11.

The processing station operates as follows.

For purifying the electrolyte 15, a partial quantity thereof is removed from the coating cell 20 through the discharge line 21 at the discharge point 1 and is filled into the reaction vessel 2. The best location of the discharge point 1 is behind a zinc dissolving system, not shown, in the area of the strip exit 12 because the pH value has already been slightly raised at this location. However, the partial quantity can also be removed directly from the circulation system 42–44 of the coating cell 20.

As soon as the reaction vessel is filled, the dissolved iron is oxidized to $Fe^{3+}$ by an addition of $H_2O_2$ which is redox-controlled by means of the measuring unit 28 from the vessel 4 through the line 26 and the metering pump 27 or alternatively by blowing air into the electrolyte. Subsequently, a metered quantity of a suspension of ZnO or $ZnCO_3$ and water is added from the vessel 3 in such a way that the pH value in the electrolyte is raised in a controlled manner. Simultaneously, the stirring apparatus 8 is in operation and the pump 7 is running for circulation purposes. The pH value is raised until the precipitation limit of $Fe^{3+}$ is reached. Under normal circumstances, the ZnO is still completely dissolved when the pH value is about 2.9 to 3.5 which corresponds to the precipitation limit of $Fe^{3+}$.

After the $Fe^{3+}$ has been precipitated, about 10% of the vessel volume of fresh electrolyte is added once again to the vessel 2 in order to dissolve any excess ZnO which may still be present. Subsequently, the electrolyte can be conducted through a suitable filter 5, for example, a filter press, a filter belt, a decanter, etc., in which the precipitated iron is filtered out. The regenerated partial quantity of electrolyte which has been freed of iron impurities is returned to the cycle. The dissolved zinc is present in the electrolyte in the form of $ZnSO_4$ and, thus, participates in the galvanizing process.

While specific embodiments of the invention have been shown and described in detail to illustrate the inventive principles, it will be understood that the invention may be embodied otherwise without departing from such principles.

We claim:

1. A method of regenerating zinc sulfate electrolyte in a steel strip electrogalvanizing process by precipitating dissolved iron from electrolyte circulating through a coating cell, the method comprising the steps of:

a) removing a partial quantity of circulating electrolyte to be regenerated;

b) oxidizing to $Fe^{3+}$ the iron dissolved in the electrolyte by a redox-controlled addition of oxidizing agent;

c) recipitating as sludge any $Fe^{3+}$ still dissolved in the electrolyte by a controlled addition of a ZnO/water suspension or a $ZnCO_3$/water suspension to raise the pH value to about 2.9 to 3.5;

d) dissolving excess ZnO or $ZnCO_3$ by adding fresh electrolyte; and e) filtering the precipitated $Fe^{3+}$ from the electrolyte and returning the regenerated partial quantity back into the circulating electrolyte.

2. The method according to claim 1, comprising using $H_2O_2$ or air as the oxidizing agent.

3. The method according to claim 1, comprising removing the partial quantity to be regenerated from an area of a strip exit of the coating cell.

4. The method according to claim 1, comprising returning the regenerated partial quantity in an area of a strip entry of the coating cell.

5. The method according to claim 1, comprising stirring the electrolyte during method steps b) through d).

6. The method according to claim 1, comprising measuring the oxygen content in the electrolyte during method step b) and adding metered amounts of oxidizing agent in accordance with the measurement results.

7. The method according to claim 1, comprising measuring the pH value in the electrolyte during method step c) and adding a metered quantity of ZnO or $ZnCO_3$ in accordance with the measurement result.

8. A plant for regenerating zinc sulfate electrolyte in a steel strip electrogalvanizing process by precipitating dissolved iron from electrolyte circulating through a coating cell, the plant comprising at least one coating cell and means for feeding a steel strip to be coated through the coating cell, and means for producing the circulation of the electrolyte through the coating cell, the plant further comprising a reaction vessel and a stirring apparatus mounted in the reaction vessel, wherein the reaction vessel is in communication with the electrolyte in the coating cell through a discharge line and a return line, further comprising a first supplementary vessel for oxidizing agent in communication with the reaction vessel through a connecting line and a first metering pump, and a second supplementary vessel for a ZnO/water suspension or $ZnCO_3$/water suspension in communication with the reaction vessel through a second connecting line and a second metering pump, wherein the second metering pump is in connection with a pH value sensor and the first metering pump is in connection with a measuring unit for determining the oxygen content in the electrolyte, and wherein a filter for filtering solids is mounted in the return line.

9. The plant according to claim 8, wherein the discharge line is connected to a discharge point of the coating cell in the area of a strip exit and the return line is connected to an input point of the coating cell in the area of a strip entry.

10. The plant according to claim 8, wherein said means for producing the circulation of the electrolyte comprises a circulation line with a circulation pump and is adapted to produce circulation comprising a flow of the electrolyte in a direction opposite to a strip travel direction through the cell.

* * * * *